US007197838B2

(12) United States Patent
Jo

(10) Patent No.: US 7,197,838 B2
(45) Date of Patent: Apr. 3, 2007

(54) CONDENSING-TYPE DRYER

(75) Inventor: Seong Jin Jo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/947,317

(22) Filed: Sep. 23, 2004

(65) Prior Publication Data

US 2005/0072017 A1 Apr. 7, 2005

(30) Foreign Application Priority Data

Sep. 24, 2003 (KR) ..... 10-2003-0066280

(51) Int. Cl.
*F26B 21/06* (2006.01)

(52) U.S. Cl. ..... 34/76; 34/513; 34/514; 34/134; 34/468; 165/913

(58) Field of Classification Search ..... 165/913, 165/111; 34/73, 76, 77, 604, 605, 513, 514, 34/134, 506, 468; 62/93
See application file for complete search history.

(56) References Cited

U.S. PATENT DOCUMENTS 4,182,411 A * 1/1980 Sumitomo et al. ..... 165/110
5,228,212 A * 7/1993 Turetta et al. ..... 34/493
5,514,248 A * 5/1996 Okuda et al. ..... 159/28.6
6,769,196 B2 * 8/2004 Park et al. ..... 34/77

FOREIGN PATENT DOCUMENTS

| | | | |
|---|---|---|---|
| EP | 0 429 953 | A2 | 6/1991 |
| EP | 0 477 554 | A1 | 8/1991 |
| FR | 2 486 220 | A1 | 1/1982 |
| GB | 2142128 | A * | 1/1985 |
| WO | WO-99/28530 | A1 | 6/1999 |
| WO | WO-01/18462 | A1 | 3/2001 |

* cited by examiner

*Primary Examiner*—Kenneth Rinehart
(74) *Attorney, Agent, or Firm*—Birch, Stewart, Kolasch & Birch, LLP

(57) ABSTRACT

A condenser of a condensing-type dryer is provided. In the condensing-type dryer, a hydrophilic film is formed on a heat emission plate by a plasma discharge. In the heat emission plate, an indoor air can be heat exchanged with a circulation air cycling in a drum. A contact angle of a condensed waterdrop formed on the heat emission plate is decreased through the hydrophilic film, thereby making it possible to decrease a flow resistance due to the condensed waterdrop.

15 Claims, 6 Drawing Sheets

CONDENSING-TYPE DRYER

This Non-provisional application claims priority under 35 U.S.C. § 119(a) on Patent Application No(s). 10-2003-0066280 filed in Korea, Republic of on Sep. 24, 2003, the entire contents of which are hereby incorporated by reference.

BACKGROUND OF THE INVENTION

1. Field of the Invention

The present invention relates to a dryer, and more particularly, to a condenser of a condensing-type dryer capable of improving heat exchange efficiency by minimizing a flow resistance due to condensed waterdrops formed on a surface of a heat emission plate, in which a circulation air that has passed through an inside of a drum and flowed into an inside of a condenser passes by the condenser.

2. Description of the Related Art

In general, a chothes dryer is a kind of electric home appliance, which sends a hot air generated by a heater into a drum and thereby dries wet clothes by absorbing moisture thereof. According to a method for processing humid air generated while drying the wet clothes, the clothes dryer is broadly divided into an exhausting-type dryer and a condensing-type dryer.

In the exhausting-type clothes dryer, the humid air generated while drying the wet clothes in a drum is exhausted to the outside of the dryer. Meanwhile, in the condensing-type clothes dryer, moisture in the humid air is condensed by a condenser, and is thereby removed from the humid air. After that, the resulting dry air flows into the inside of the drum, thereby re-circulating the dry air in the drum.

In the condensing-type clothes dryer, a circulation air of high temperature and low humidity heated by a heater flows in an inside of the drum. The circulation air having flowed into the drum absorbs moisture of wet clothes in the drum and is phase changed into a state of high temperature and high humidity. The high temperature and high humidity circulation air is phase changed into a state of low temperature and high humidity through a heat exchange operation while passing through the condenser. When the temperature of the circulation air drops below the dew point, moisture in the circulation air is condensed and then condensed waterdrops form on a heat emission plate.

The condensed waterdrops formed on the heat emission plate operates as a flow channel resistance factor obstructing a flow of the circulation air passing through the condenser. In addition, a contact angle between the condensed waterdrop and the heat emission plate is large, and thereby the flow channel resistance increases.

In other words, a pressure of an outlet of the condenser is lower than that of an inlet of the condenser due to the flow channel resistance. In this case, driving power of a fan should be increased for the same air flow, thereby resulting in increase of power consumption. Consequently, heat exchange efficiency of the condenser is deteriorated owing to the condensed waterdrops formed on the heat emission plate.

Also, when the condensed waterdrops formed on the meat emission plate grow, condensed water drops formed on upper and lower heat emission plate contact with each other, thereby forming a bridge. The formation of the bridge doubles a flow resistance.

SUMMARY OF THE INVENTION

Accordingly, the present invention is directed to a condenser of a condensing-type dryer that substantially obviates one or more problems due to limitations and disadvantages of the related art.

An object of the present invention is to provide a condenser of a condensing-type dryer, which decreases a flow resistance due to condensed waterdrops formed on a surface of a heat emission plate while a circulation air having passed through a drum passes through a condenser, by improving characteristics of the surface of the heat emission plate.

Another object of the present invention is to provide a condensing-type clothes dryer, which decrease a flow resistance due generated while circulation air passes through a condenser, thereby making it possible to improve heat exchange efficiency of the condenser and drying performance of the dryer.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a condensing-type dryer includes: a condenser having one or more heat emission plates, one or more cooling fins attached to the heat emission plates, and a hydrophilic film formed on the lower and/or upper surface of the heat emission plates; and a base receiving the condenser.

In another aspect of the present invention, a condensing-type dryer includes: a drum receiving wet clothes; a condenser having one or more heat emission plates stacked spaced apart from one another by a predetermined distance for heat exchange of air having passed through the drum, one or more cooling fins installed between the heat emission plates, and a film formed on at least one side of the heat emission plates; and a base mounting the condenser.

In further another aspect of the present invention, a condensing-type dryer includes: a condenser having a heat emission plate heat-exchanged with air of high temperature and high humidity in a dryer, and a hydrophilic film formed on an surface of the heat emission plate so that a condensed waterdrop smoothly flows down; and a base receiving the condenser in a detachable manner.

The present invention can decrease a contact angle between a condensed waterdrop and a surface of a heat emission plate by plasma processing the surface of the heat emission plate of a condenser.

Further, the present invention can decrease a flow resistance due to a condensed waterdrop formed on the surface of the heat emission plate by decreasing the contact angle between the condensed waterdrop and the surface of the heat emission plate.

Therefore, the present invention can improve drying performance of the condensing-type clothes dryer by increasing heat exchange efficiency of the condenser.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
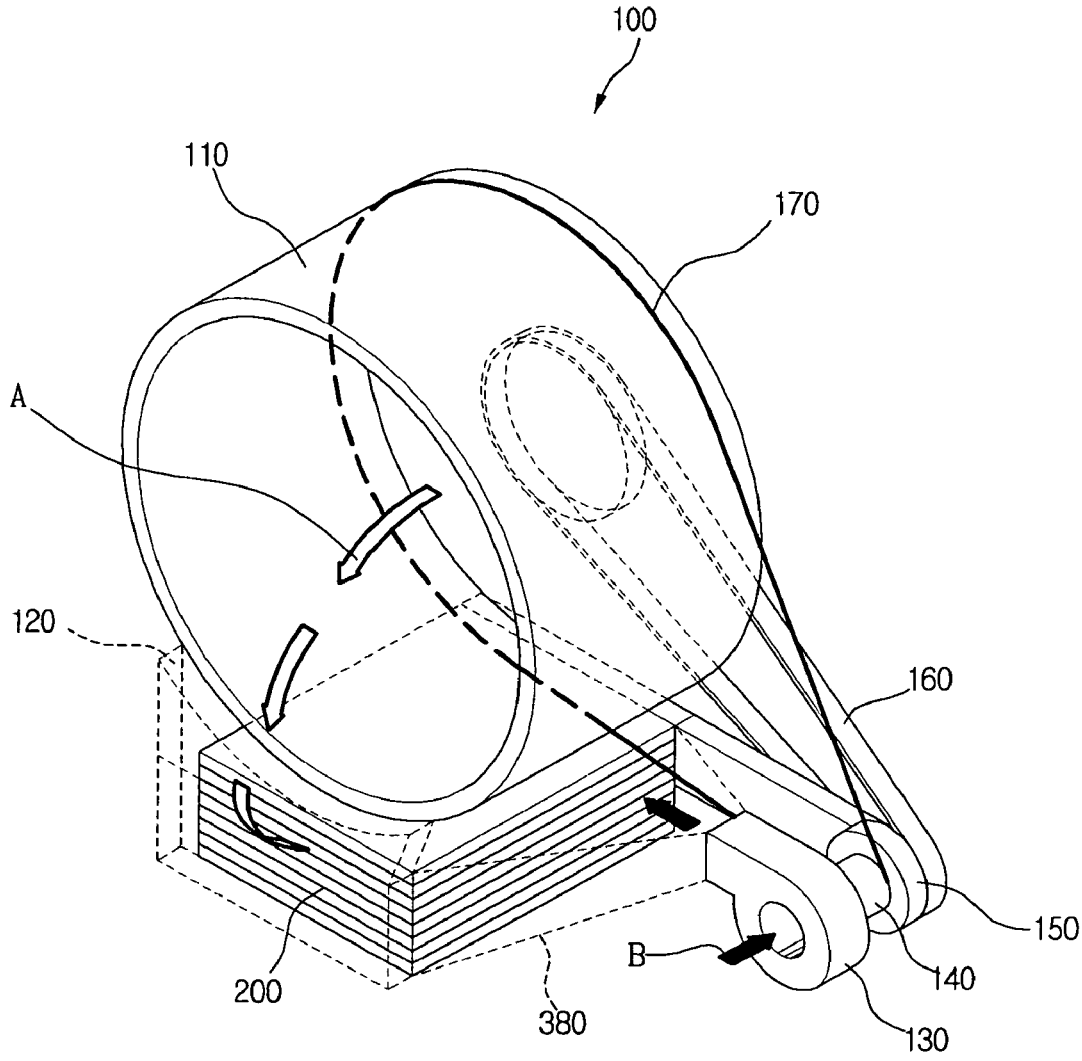
FIG. 1 is a perspective view showing a main part of a clothes dryer equipped with a condenser according to an embodiment of the present invention.

FIG. 1 is a perspective view showing a main part of a clothes dryer equipped with a condenser according to an embodiment of the present invention.

Referring to FIG. 1, a clothes dryer 100 according to the present invention includes a cylinder-shaped drum 110 receiving wet clothes therein and having lifters (not shown) on an inner surface thereof, a filter 120 removing particles such as nap from circulation air A of high temperature and high humidity passing through the drum 110, and a condenser 200 condensing moisture of circulation air A flowing from the filter 120 through heat exchange operation.

In detail, a belt 170 is wound on an outer surface of the drum 110 and connected to a driving motor 140. Therefore, the drum 110 is rotated at a given speed by rotation of the driving motor 140.

Also, the clothes dryer 100 includes a cooling fan 130 pivotally connected to one side of the driving motor 140, for inhaling the indoor air B, a ventilation fan 150 pivotally connected to the other side of the driving motor 140, for inhaling the circulation air A passing through the condenser 200, and a drying duct 160, one end of which is connected to the ventilation fan 150 and the other end of which is connected to a rear wall of the drum 110, for guiding the circulation air A inhaled by the ventilation fan 150 to an inside of the drum 110. In detail, a heater (not shown) for heating the circulation air A is installed in the inside of the drying duct 160.

Further, the clothes dryer 100 includes a condensing duct 380 for guiding the indoor air B inhaled by the cooling fan 130 to the condenser 200.

Reference will now be made to an air flow generated in the inside of the clothes dryer 100.

First, the circulation air A ascends through the drying duct 160, and is phase-changed into a state of high temperature and low humidity by the heater. The high temperature and low humidity circulation air A flows through the rear wall of the drum 110 into the inside of the drum 110, and is phase-changed into a state of high temperature and high humidity by absorbing moisture of wet clothes in the drum 110. The high temperature and high humidity circulation air A passes through the filter 120 installed in a front side of the drum 110, whereby nap is removed from the circulation air A by the filter 120. The circulation air A having passed through the filter 120 flows into the condenser 200 and thereby is heat-exchanged with the indoor air B.

Here, the circulation air A is changed in its phase into a state of low temperature and high humidity by being heat-exchanged with the indoor air B in the condenser 200. When the temperature of the circulation air A drops below the dew point, water vapor in the circulation air A is condensed and then condensed waterdrops form on a heat emission plate of the condenser 200.

In the meantime, the circulation air A is phase-changed into a state of low temperature and low humidity by the heat exchange operation in the condenser 200, and then the low temperature and low humidity circulation air A re-flows into the drying duct 160 by an operation of the ventilation fan 150.

Figure 2:
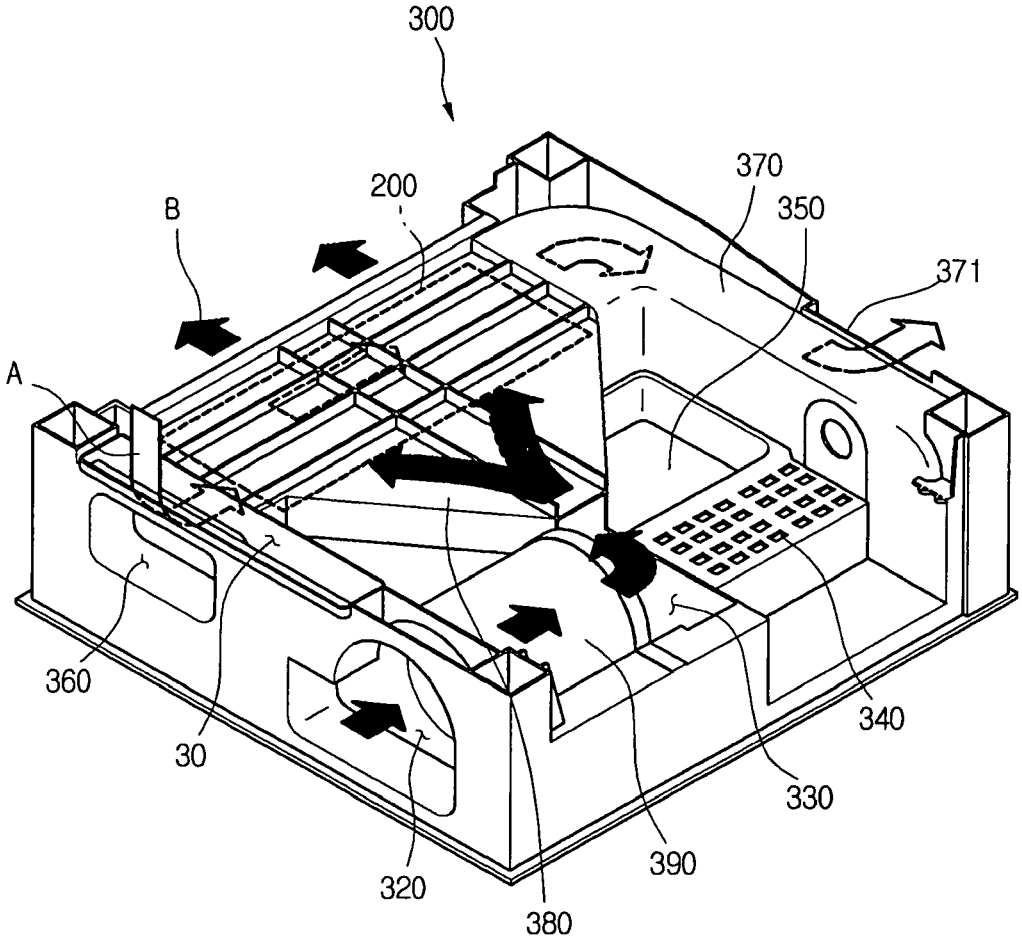
FIG. 2 is a perspective view showing a base part of a clothes dryer mounted with a condenser according to an embodiment of the present invention.
Figure 3:
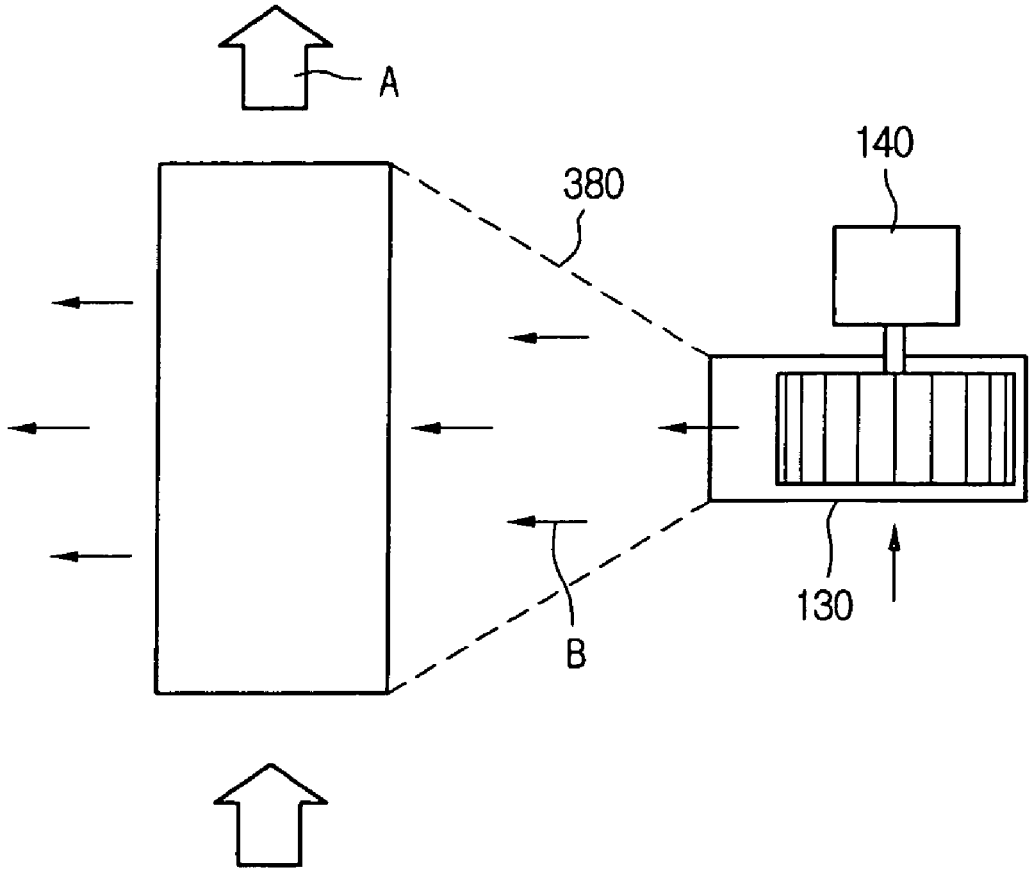
FIG. 3 is a plane view showing the flow of circulation air generated in the base part and an indoor air.

FIG. 2 is a perspective view showing a base part of a clothes dryer mounted with a condenser according to an embodiment of the present invention, and FIG. 3 is a plane view showing the flow of circulation air generated in the base part and an indoor air.

Referring to FIG. 2 and FIG. 3, the condenser 200 is installed into the inside of a base 300 installed on a lower surface of the clothes dryer 100.

Flow channels of the circulation air A and the indoor air B are formed in the inside of the base 300. It should be noted that the shape of the base 300 and the formation position of the flow channels are not limited to embodiments of the present invention.

The base 300 includes an insertion hole 360 formed on a part of a front side of the base 300, the condenser 200 being inserted into the hole 360, and an inhalation hole 320 formed on another part of the front side of the base 300, which is spaced apart from the part of the front side of the base 300 by a predetermined distance, the indoor air B being inhaled into the hole 320, and a blower 390 into which the indoor air B is inhaled through the hole 320, and a seating groove 330 formed at an end portion of the blower 390, the drying fan 130 being seated in the groove 330.

Also, the base 300 includes a condensing duct 380 which is extended in its length from the seating groove 330 and is formed at an approximately vertical direction with the blower 390, and a flow channel 370, the circulation air A having passed through the condensing duct 380 and the condenser 200 flowing through the flow channel 370.

An end portion of the condensing duct 380 is connected to the condenser 200, and the ventilation fan 150 is installed in an inside of an end portion of the flow channel 370. A connection portion 371 connected to a lower part of the drying duct 160 is formed at an end portion of the flow channel 370. An receiving unit 340, on which the driving motor 140 is mounted, is formed between the seating groove 330 and the flow channel 370. A storage case 350, in which condensed water generated in the condenser 200 is stored, is formed in the middle of the base 300.

Reference will now be made to an air flow generated in an inside of the base 300. The circulation air A having passed through the drum 110 and the filter 120 flows into the condenser 200 installed in the inside of the base 300. Moisture of the circulation air A is then condensed by heat exchange operation in the condenser 200. The low temperature and low humidity circulation air A having passed through the condenser 200 flows through the flow channel 370 into the drying duct 160. The low temperature and low humidity circulation air A ascends through the drying duct 160, and is phase-changed into a state of high temperature and low humidity by the heater installed in the drying duct 160. The high temperature and low humidity circulation air A re-flows into the inside of the drum 110.

The indoor air B, which is heat exchanged with the circulation air A, flows through the inhalation hole 320 into the blower 390. Here, the indoor air B flows into an inside of the blower 390 by the cooling fan 130 installed in the seating groove 330.

The indoor air B inhaled by the cooling fan 130 passes through the condensing duct 380 into the condenser 200. The indoor air B is heat exchanged with the circulation air A while passing through the condenser 200.

Figure 4:
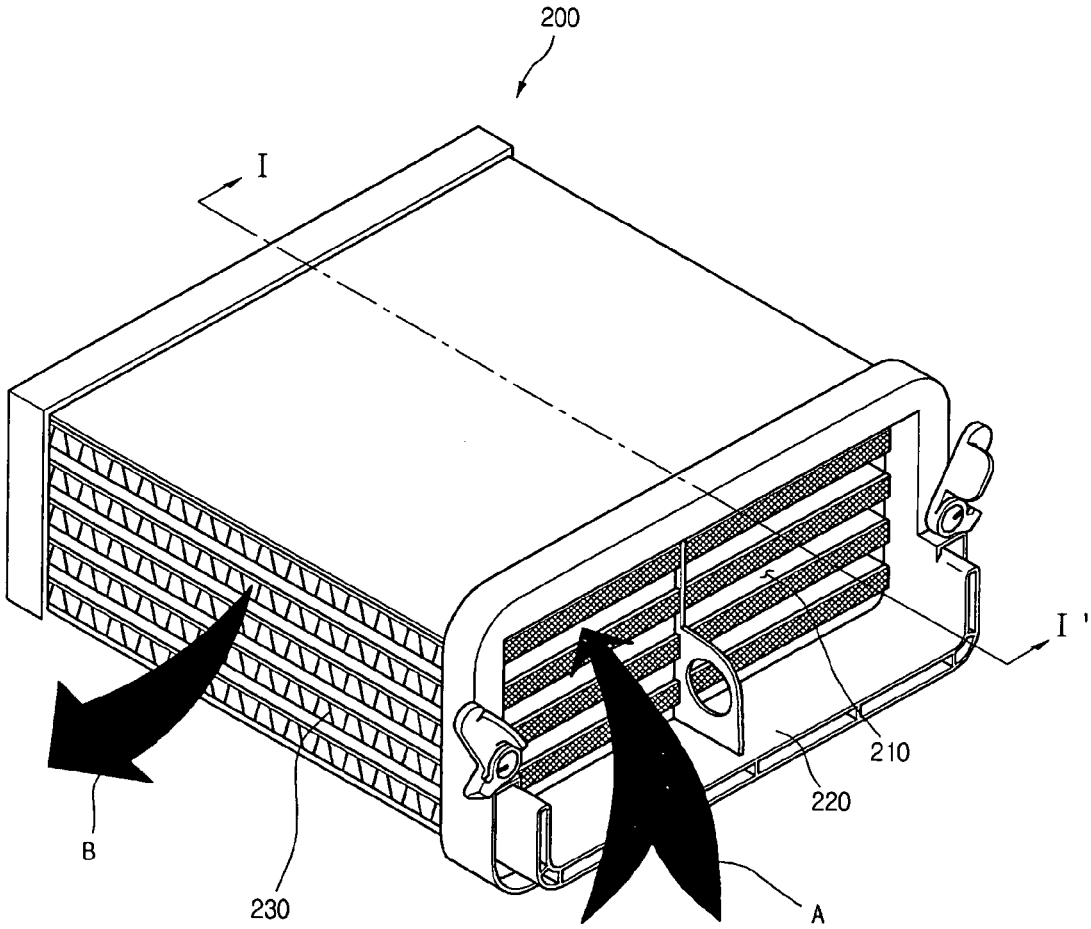
FIG. 4 is a perspective view of a condenser according to an embodiment of the present invention.
Figure 5:
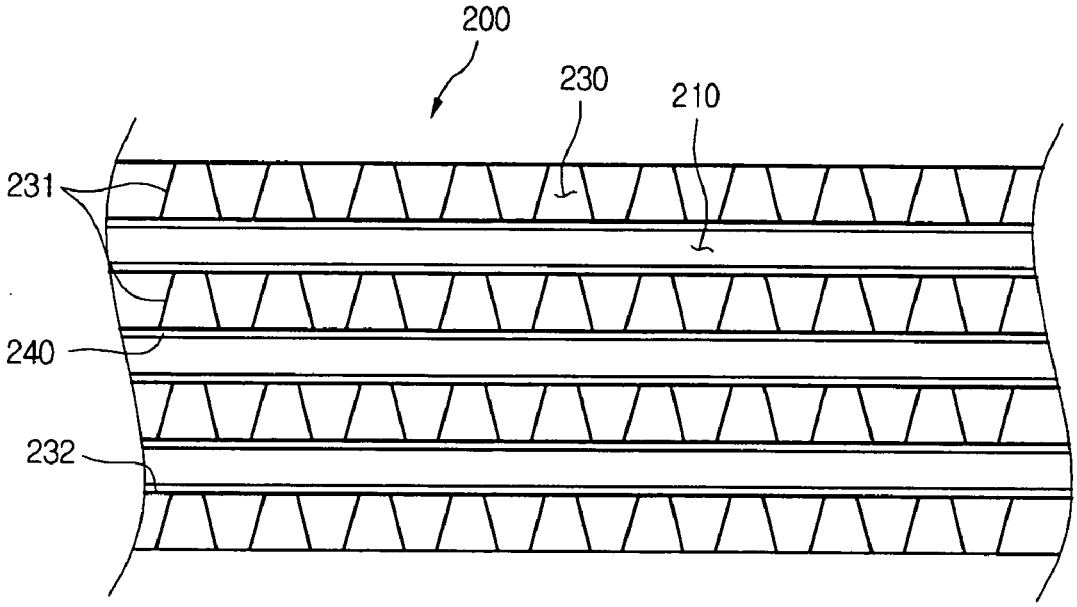
FIG. 5 is a cross-sectional view of a side of the condenser taken along line I–I' in FIG. 4.

FIG. 4 is a perspective view of the condenser 200, and FIG. 5 is a cross-sectional view of a side of the condenser 200 taken along line I–I' in FIG. 4.

Referring to FIG. 4 and FIG. 5, the shape of the condenser 200 is similar to a rectangular parallelopiped. However, it should be noted that the shape and size of the condenser 200 is not limited to embodiments of the present invention.

The condenser 200 is constructed in such a way that circulation air passages 210 through which the circulation air A from the drum 110 passes and indoor air passages 230 through which the indoor air B inhaled by the cooling fan 130 passes are stacked spaced apart from one another by a predetermined distance. Also, the condenser 200 includes a front cover 220 installed on a front side thereof, which is attachable and detachable by users' hand.

The circulation air passages 210 are extended from the front of the condenser 200 to the rear thereof, and the indoor air passages 230 are extended from one side to another side of the condenser 200 in such a way that the passages 210 are perpendicular to the passages 230. Therefore, the circulation air A passing through the passages 210 makes a heat-exchange with the indoor air B passing through the passages 230, without being mixed. If the temperature of the circulation air A passing through the passages 210 drops below the dew point, moisture in the circulation air A is condensed, and then condensed waterdrops form on the bottom of the passages 210.

Figure 6:
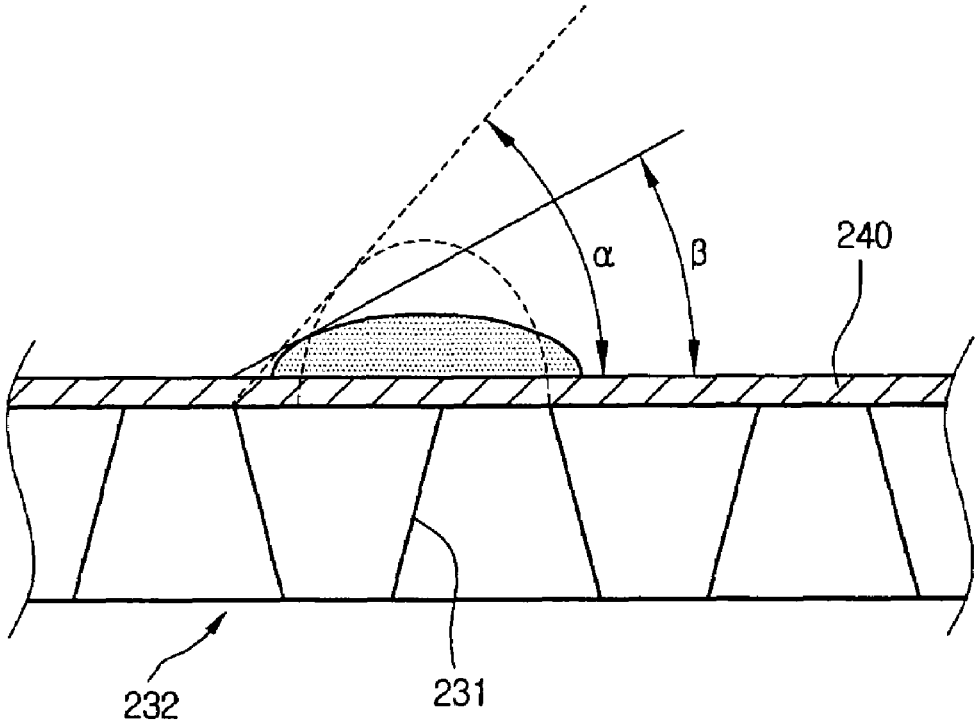
FIG. 6 is a cross-sectional view showing a situation where a condensed waterdrop is formed on a heat emission plate of the condenser according to an embodiment of the present invention.

FIG. 6 is a cross-sectional view showing a situation where a condensed waterdrop is formed on a heat emission plate of the condenser 200.

Referring to FIG. 6, the condenser 200 is formed in such a way that the circulation air passages 210 through and the indoor air passages 230 are stacked spaced apart from one another by a predetermined distance, as stated above.

A heat emission plate 232 forms a border between the circulation air passages 210 and the indoor air passages 230. Here, the indoor air passages 230 are installed between an upper heat emission plate and a lower heat emission plate in a saw-toothed shape. Cooling fins 231 are formed between the indoor air passages 230, thereby broadening an indoor air contact area. A high molecular polymerization film 240 made by plasma treatment is formed on the surfaces of the lower and upper emission plates of the circulation air passages 210.

Here, the high molecular polymerization film 240 formed on the surface of the heat emission plate 232, may be made by DC (Direct Current) plasma discharge or RF (Radio Frequency) plasma discharge.

In the plasma treatment process for the surface of the heat emission plate 232, firstly, the heat emission plate 232 is inserted into a vacuum chamber (not shown), and then the inside of the vacuum chamber is phase-changed into a vacuum state. An unsaturated aliphatic hydrocarbon such as acetylene and a nonpolymerizable gas such as nitrogen are then injected into the inside of the heat emission plate 232. Thereafter, a high molecular polymerization film 240 is formed on the surface of the heat emission plate 232 through DC plasma discharge and RF plasma discharge.

In the meantime, the plasma treatment process briefly stated above is described in detail in the patent application (International Application No. PCT/KR1998/00398)) by the present invention.

Reference will now be made to an operation of the condenser 200.

When a hydrophilic high-molecular polymerization film 240 is formed on a surface of the heat emission plate 232 through the plasma treatment process stated above, a contact angle between the surface of the heat emission plate and a condensed waterdrop formed thereon becomes smaller, as compared with the state of the art.

The contact angle is related to a degree of spread of a waterdrop, in case where a waterdrop is dropped on the surface of a specific material. As a diameter of a waterdrop dropped on a surface of a specific material increases, a height of the waterdrop decreases and thereby a contact angle between a surface of the waterdrop and the surface of the specific material decreases. That the contact angle is small means that the specific material is more hydrophilic with respective to the waterdrop. In this respect, as the contact angle between the surface of the heat emission plate and the condensed waterdrop formed thereon decreases, a flow resistance of the circulation air passing through the condenser 200 decreases.

As shown in FIG. 6, as compared with a contact angle $\alpha$ between a condensed waterdrop and the prior art heat emission plate, a contact angle $\beta$ between a condensed waterdrop and the heat emission plate 232 according to the present invention is extremely small. Particularly, when a surface of the heat emission plate is plasma processed, the contact angle $\beta$ is below 10°. If the contact angle is above 10°, then moisture cannot flow down from the surface of the heat emission plate at a proper manner due to weakness of characteristics of a hydrophilic film. Also, if the contact angle is above 10°, then the flow resistance of the circulation air passing through the condenser 200 is less decreased.

As stated above, the present invention can decrease the flow resistance of the circulation air passing through the condenser 200 by closely adhering the condensed waterdrop to the surface of the heat emission plate, thereby making it possible to improve heat exchange efficiency of the condenser 200.

Also, the condenser of the condensing-type clothes dryer according to the present invention can improve the hydrophilic property of the surface of the heat emission plate by plasma-processing the surface, thereby making it possible to decrease the contact angle between the condensed water and the heat emission plate.

Further, the present invention can improve drying performance of the condensing-type clothes dryer by increasing heat exchange efficiency of the condenser.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A condensing-type clothes dryer comprising:

a condenser to condense water vapor from moisture-containing air in the clothes dryer that flows through the condenser in a given direction, including one or more heat emission plates one or more cooling fins attached to the heat emission plates, and a hydrophilic film formed on a lower and/or upper surface of the heat emission plates; and a dryer base for receiving the condenser in a detachable manner, the dryer base including an inhalation hole for receiving indoor air, blower means for drawing ambient air into the inhalation hole in a direction that is parallel to the given direction of flow of the moisture-containing air that flows through the condenser and for redirecting the ambient air through the condenser in a direction which is substantially perpendicular to the given direction of flow of the moisture-containing air flowing in the condenser.

2. A condensing-type clothes dryer comprising:

a condenser to condense water vapor from moisture-containing air in the clothes dryer including one or more heat emission plates, one or more cooling fins attached to the heat emission plates, and a hydrophobic film formed on a lower and/or upper surface of the heat emission plates; and a dryer base for receiving the condenser in a detachable manner, wherein a flow channel through which a circulation air having passed through a drum flows is perpendicular to a flow channel through which an indoor air heat-exchanged with the circulation air flows in the condenser;

wherein the hydrophilic film is formed by a plasma discharge.

3. The condensing-type dryer according to claim 2, wherein the hydrophilic film is formed on an entire surface of the heat emission plates.

4. The condensing-type dryer according to claim 2, wherein the hydrophilic film is formed on a partial surface of the heat emission plate.

5. The condensing-type dryer according to claim 2, wherein the heat emission plates are stacked spaced apart from one another by a predetermined distance.

6. The condensing-type dryer according to claim 2, wherein the hydrophilic film is formed of a high molecular polymerization film.

7. The condensing-type dryer according to claim 2, wherein a circulation air passage through which a circulation air having passed through a drum flows is formed between the heat emission plates.

8. The condensing-type dryer according to claim 2, wherein an indoor air passage through which an indoor air flows is formed between the heat emission plates.

9. The condensing-type dryer according to claim 2, wherein a flow channel through which a circulation air having passed through a drum flows and a flow channel through which an indoor air flows are alternately stacked.

10. The condensing-type dryer according to claim 2, wherein the cooling fins are installed in a passage through which an indoor air flows.

11. The condensing-type dryer according to claim 2, wherein a contact angle between a condensed waterdrop and a surface of the hydrophilic film on which the condensed waterdrop is formed is below 10°.

12. A condensing-type clothes dryer comprising:

a condenser to condense water vapor from moisture-containing air in the clothes dryer including one or more heat emission plates, one or more cooling fins attached to the heat emission plates, and a hydrophobic film formed on a lower and/or upper surface of the heat emission plates; and a dryer base for receiving the condenser in a detachable manner, wherein a flow channel through which a circulation air having passed through a drum flows is perpendicular to a flow channel through which an indoor air heat-exchanged with the circulation air flows in the condenser;

wherein the hydrophilic film is formed by a DC (direct current) plasma discharge.

13. A condensing-type clothes dryer comprising:

a condenser to condense water vapor from moisture-containing air in the clothes dryer including one or more heat emission plates, one or more cooling fins attached to the heat emission plates, and a hydrophobic film formed on a lower and/or upper surface of the heat emission plates; and a dryer base for receiving the condenser in a detachable manner, wherein a flow channel through which a circulation air having passed through a drum flows is perpendicular to a flow channel through which an indoor air heat-exchanged with the circulation air flows in the condenser;

wherein the hydrophilic film is formed by an RF (radio frequency) plasma discharge.

14. A condensing-type clothes dryer comprising:

a drum for receiving wet clothes and hot air with low humidity and in which the hot air absorbs moisture of the wet clothes;

a condenser including one or more heat emission plates stacked spaced apart from one another by a predetermined distance for heat exchange of air having passed through the drum and become moist air to condense moisture from the moist air, one or more cooling fins installed between the heat emission plates, and a film formed on at least one side of the heat emission plates; and a dryer base mounting the condenser in a detachable manner, wherein a flow channel through which a circulation of air having passed through a drum flows is perpendicular to a flow channel through which an indoor heat-exchanger with the circulation air flows in the condenser;

wherein the film is formed by a DC (direct current) plasma discharge.

15. A condensing-type clothes dryer comprising:

a drum for receiving wet clothes and hot air with low humidity and in which the hot air absorbs moisture of the wet clothes;

a condenser including one or more heat emission plates stacked spaced apart from one another by a predetermined distance for heat exchange of air having passed through the drum and become moist air to condense moisture from the moist air, one or more cooling fins installed between the heat emission plates, and a film formed on at least one side of the heat emission plates; and a dryer base mounting the condenser in a detachable manner, wherein a flow channel through which a circulation of air having passed through a drum flows is perpendicular to a flow channel through which an indoor heat-exchanger with the circulation air flows in the condenser;

wherein the film is formed by an RF (radio frequency) plasma discharge.

* * * * *